US006510778B1

(12) United States Patent
Irwin

(10) Patent No.: US 6,510,778 B1
(45) Date of Patent: Jan. 28, 2003

(54) AUTOMATIC BOLT HOLD-OPEN ASSEMBLY

(75) Inventor: Michael B. Irwin, Jackson, SC (US)

(73) Assignee: Custom Shooting Technologies, Inc., Louisville, KY (US)

( * ) Notice: Subject to any disclaimer, the term of this patent is extended or adjusted under 35 U.S.C. 154(b) by 63 days.

(21) Appl. No.: 09/750,895

(22) Filed: Dec. 28, 2000

(51) Int. Cl.[7] ..... F41A 7/00

(52) U.S. Cl. ..... 89/138; 89/128; 89/143; 42/16; 42/17; 42/21; 42/70.02

(58) Field of Search ..... 42/21, 16, 17, 42/70.02; 89/140, 138, 128, 143

(56) References Cited

U.S. PATENT DOCUMENTS

| | | | | | |
|---|---|---|---|---|---|
| 804,748 | A | * | 2/1905 | Von Mannlicher | |
| 2,321,045 | A | * | 6/1943 | Roemer | |
| 2,325,395 | A | * | 7/1943 | Hammond | |
| 2,330,737 | A | * | 9/1943 | Pedersen | 42/16 |
| 2,363,772 | A | * | 11/1944 | Browning | |
| 2,388,443 | A | | 11/1945 | Ruger | 89/2 |
| 2,481,548 | A | * | 9/1949 | Waltke, Jr. | 42/16 |
| 2,548,622 | A | * | 4/1951 | Sampson et al. | 42/69.02 |
| 2,714,334 | A | * | 8/1955 | Harvey | |
| 2,742,822 | A | * | 4/1956 | Harvey | 42/69.03 |
| 3,024,559 | A | * | 3/1962 | Weatherby | 42/70.06 |
| 3,156,993 | A | * | 11/1964 | Into | 42/17 |
| 3,446,114 | A | | 5/1969 | Ketterer | 89/140 |
| 3,570,366 | A | | 3/1971 | Nickel | 89/138 |
| 3,656,400 | A | * | 4/1972 | Stoner et al. | |
| 3,688,640 | A | | 9/1972 | Seecamp | 89/138 |
| 3,846,928 | A | | 11/1974 | Ruger et al. | 42/16 |
| 4,056,038 | A | | 11/1977 | Rath | 89/128 |
| 4,057,003 | A | | 11/1977 | Atchisson | 89/138 |
| 4,058,922 | A | | 11/1977 | Elbe et al. | 42/16 |
| 4,433,610 | A | | 2/1984 | Tatro | 89/148 |
| 4,438,678 | A | | 3/1984 | Ruger | 89/138 |
| 4,455,919 | A | | 6/1984 | Osborne et al. | 89/138 |
| 4,697,495 | A | | 10/1987 | Beretta | 89/143 |
| 4,719,841 | A | | 1/1988 | Perrine | 89/189 |
| 5,614,691 | A | * | 3/1997 | Taylor | |

FOREIGN PATENT DOCUMENTS

| | | | |
|---|---|---|---|
| GB | 151196 | * | 9/1920 |
| GB | 21794269 A | * | 3/1987 |

OTHER PUBLICATIONS

Sturm, Ruger and Company, Inc., Instruction Manual for Ruger Model 10/22 Carbine, 1991.

* cited by examiner

*Primary Examiner*—Michael J. Carone
*Assistant Examiner*—John Richardson
(74) *Attorney, Agent, or Firm*—James C. Eaves, Jr.; Karen L. Lynd; Greenbaum Doll & McDonald PLLC

(57) ABSTRACT

The present invention relates to an automatic bolt hold-open rotating assembly to convert a manual bolt hold-open function to an automatic bolt hold-open function in automatic and semi-automatic pistols and rifles, such as the Ruger 10/22 semi-automatic .22 caliber rifle. The components of the assembly readily replace standard factory components in the trigger assembly and replace the standard magazine. The assembly comprises a magazine with channel cutout, a bolt stop, a bolt stop handle for manual manipulation of the assembly, a bolt stop spring to apply clockwise pressure on assembly, a cartridge detecting lever which also serves as a cartridge ejector pivotably mounted on bolt stop with an extension which interfaces with channel cutout of magazine, a tab protruding from the ejector lever which rides in a slot on the bolt stop to limit pivoting of the cartridge detecting lever, and a lever spring allowing counter-clockwise pivoting of cartridge detecting lever to facilitate insertion of recharged magazine.

12 Claims, 8 Drawing Sheets

AUTOMATIC BOLT HOLD-OPEN ASSEMBLY

BACKGROUND OF THE INVENTION (a) Field of the Invention

The present invention relates to an automatic bolt hold-open rotating assembly to convert a manual bolt hold-open function to an automatic bolt hold-open function in automatic and semi-automatic pistols and rifles, such as the Ruger 10/22 semi-automatic .22 caliber rifle. The components of the assembly readily replace standard factory components in the trigger assembly and replace the standard magazine. The assembly comprises a magazine with channel cutout, a bolt stop, a bolt stop handle for manual manipulation of the assembly, a bolt stop spring to apply clockwise pressure on assembly, a cartridge detecting lever which also serves as a cartridge ejector pivotably mounted on bolt stop with an extension which interfaces with channel cutout of magazine, a tab protruding from the ejector lever which rides in a slot on the bolt stop to limit pivoting of the cartridge detecting lever, and a lever spring allowing counter-clockwise pivoting of cartridge detecting lever to facilitate insertion of recharged magazine.

In the field of automatic rifles and pistols, most bolts are held open automatically upon discharging the last cartridge in the magazine. Most systems rely on the presence of specially designed magazine followers to hold the bolt open, particularly where magazines contain cartridges in a straight axis. Holding the bolt open allows a simple reinsertion of a freshly charged magazine and a simple means of loading a cartridge into the chamber and closing the bolt on the cartridge either by manipulating a lever or by pulling the bolt rearward and releasing. Keeping the bolt held open after the last shot also eliminates undesirable dry-firing and allows thee chamber to be easily inspected for the presence of a cartridge. This is generally held to be safer when operating automatic firearms.

The bolt hold-open assembly of the present invention operates to hold open the bolt of a firearm after the last cartridge has been discharged from the preferably rotary magazine by automatically rotating into position to hold the bolt open when the last cartridge has been ejected. The assembly of the present invention eliminates the need for specially designed magazine followers.

(b) Description of the Prior Art

U.S. Pat. No. 3,446,114 to W. Ketterer teaches a trigger mechanism for automatic firearms employing a hammer firing device, having a means for converting both from semi-automatic to full-automatic firing and, simultaneously, from closed bolt to open bolt operation, including a catch lever, which, when the firearm is in an automatic firing mode, projects into the passive movement of the breech block, catching and holding the breech block in its rearward position, and further including a driving member for displacing the catch lever from its normal position.

U.S. Pat. No. 3,688,640 to Seecamp teaches a bolt-open latch for a repeating firearm where the bolt-open latch becomes operable by movement of a cartridge carrier beyond its cartridge-feeding position, in order to latch the breech-bolt in an open position when no cartridge is available to be fed into the chamber.

U.S. Pat. No. 3,846,928 to Ruger et al. teaches a bolt lock means comprised of a longitudinally disposed bolt lock lever pivotally mounted on the side of the cartridge receiver and having a magazine follower engaging arm at the forward end thereof and a bolt stop arm at the rearward end thereof.

U.S. Pat. No. 4,057,003 to Atchisson teaches an open-bolt firing conversion for the standard M16 rifle, which allows the rifle to be converted to open-bolt firing by replacement of parts.

U.S. Pat. No. 4,455,919 to Osborne et al. teaches an action disabling device in a firearm in the form of an operating arm pivotable in and out of the closing path of the breech bolt to stop the breech bolt on partial closure of the same whereby the operating arm pivots when engaged by the cartridge lifter during overtravel of the lifter in lift direction for lack of a cartridge thereon.

U.S. Pat. No. 4,697,495 to Beretta teaches a tripping mechanism for the conversion of automatic rifles of the closed-bolt to the open-bolt type, to allow the selection of either single firing or automatic fire. The components are premounted within a box-like support which is readily insertable in the trip box of a conventional automatic rifle.

SUMMARY OF THE INVENTION

The present invention relates to an automatic bolt hold-open rotating assembly to convert a manual bolt hold-open function to an automatic bolt hold-open function in automatic and semi-automatic pistols and rifles, such as the Ruger 10/22 semi-automatic .22 caliber rifle. The components of the assembly readily replace the standard magazine and standard factory components in the trigger assembly, generally identified by manufacturers as follows: bolt lock, ejector, bolt lock spring, and ejector pin. All parts of the present invention are easily installed, and the invention can be easily removed and the firearm easily converted back to its original factory form.

The present invention is designed-to provide an automatic bolt hold-open function in the Ruger 10/22 semi-automatic .22 caliber rifle, in addition to other pistols and rifles. This Ruger rifle functions as follows when a loaded magazine is inserted: The bolt is retracted by manual retraction of the bolt handle. Retracting the bolt cocks the hammer and compresses the recoil spring. Manually releasing the bolt from its retracted position allows the bolt to move forward, driven by decompression of the recoil spring. As the bolt moves forward, it removes a cartridge from the magazine and pushes it forward of the magazine into the gun chamber. The bolt is held against the head of the chambered cartridge by the remaining compression of the recoil spring. Retraction of the trigger releases the cocked hammer, which strikes the rear of the firing pin. The front end of the firing pin is forced forward into the head of the cartridge casing. The firing pin indents the rim of the cartridge case and ignites the priming compound inside the rim. The ignited priming compound ignites the gun powder in the cartridge case, instantly generating a large volume of gas. The gas exerts pressure on the interior of the cartridge case, forcing the bullet out of the cartridge case and down the bore. The gas also exerts pressure on the cartridge casing head, which is in contact with the bolt. This pressure causes the bolt to move rearward. As the bolt retracts, a hook shaped extractor located on an inside wall of the clearance groove in the bolt bottom extracts the spent cartridge case from the chamber and draws the cartridge back across the upper surface of the magazine. As the cartridge is drawn rearward by the bolt, the cartridge head collides with an ejector tab which projects upward from a side of the magazine surface, interrupting the rearward path of the spent cartridge case. The impact of the cartridge case against the ejector tab pushes the cartridge case to the opposed side, away from the ejector tab, and ejects the cartridge case from the chamber. In a firearm designed for right-handed firing, the hook shaped extractor is located on the right inside wall of the clearance groove and the ejector tab projects upward from the left upper surface of the magazine so that the spent cartridges are ejected to the right, away from the face and body of the user. Likewise, in a firearm designed for left-handed firing, the hook shaped extractor is located on a the left inside wall of the clearance groove and the ejector tab projects upward from the right upper surface of the magazine so that the spent cartridges are ejected to the left.

As the bolt continues on its rearward path, it also recocks the hammer and recompresses the recoil spring. After completing its rearward travel, the bolt is then automatically forced forward by decompression of the recoil spring, again stripping a cartridge from the magazine and feeding the cartridge into the chamber. This cycle is repeated each time the trigger is pulled until there are no more cartridges in the magazine or in the chamber.

If the magazine is removed and a cartridge is left in the chamber, the firearm will discharge when the trigger is retracted. The firearm may also be used as a single shot firearm by removing the magazine and manually loading-the chamber with a single cartridge. In either case, as the bolt retracts after the firearm is discharged, it extracts the spent cartridge case from the chamber. As the cartridge is drawn rearward by the bolt, the cartridge head collides with a fixed ejector lever, which interrupts the rearward path of the spent cartridge case and ejects the cartridge case from the chamber in the same manner as the magazine ejector tab.

The bolt does not remain open after the last shot has been discharged, nor does the bolt automatically lock open when the magazine is empty. After the last cartridge is discharged, in the absence of a mechanism to hold the bolt open, the bolt will again be forced rearward and then forward; however, the bolt will this time close on an empty chamber, creating a condition where the firearm may accidently be dry fired. Further, to ensure that the firearm is unloaded, the user must manually retract the bolt to inspect the chamber. The user must also manually retract the bolt handle to recock the hammer in order to discharge the firearm after reloading.

The present invention comprises a bolt hold-open assembly which rotates about a pin to automatically rotate into position to hold the bolt open when the last cartridge has been ejected from the magazine. Clockwise force to encourage rotation of the assembly is provided by a bolt stop spring, which interfaces with the assembly and the firearm's trigger housing. A cartridge detection lever is pivotably connected to a bolt stop. An elongated finger-like extension of the first end of the cartridge detecting lever interfaces with a channel cutout in the magazine, at the position of the cartridge head. A tab protruding from the second end of the cartridge detection lever rides in a slot on the bolt stop. The length of the slot controls the degree of pivoting of the lever. A lever spring, which is compressed between fixed rods located on the bolt stop and cartridge detection lever, provides an upward clockwise bias upon the lever and encourages the protruding tab against the topside of the bolt stop slot. The bias provided by the lever spring is greater than the clockwise force on the assembly provided by the bolt stop spring, which therefore prevents the lever from rotating in a counter-clockwise direction when the assembly rotates in a clockwise direction. Counter-clockwise pivoting of the lever is only accomplished upon insertion of a loaded magazine when the assembly is held in clockwise rotation by contact with the retracted bolt because the counter-clockwise force exerted by the presence of a cartridge in the magazine overcomes the clockwise bias provided by the lever spring.

Automatic clockwise rotation of the bolt hold-open assembly from a position of zero rotation is dependent upon the presence or absence of a cartridge in the magazine. Discharge of the last cartridge in the magazine causes the elongated finger-like extension, previously resting upon the cartridge head, to pivot in a clockwise direction to rest against the floor of the magazine channel cutout. The upward bias of the lever spring and the clockwise force provided by the bolt stop spring cause the bolt hold-open assembly to rotate clockwise to a position of full clockwise rotation. This rotation elevates a portion of the bolt stop into the path of the bolt, halting the bolt's forward travel and holding the bolt-open assembly in full clockwise rotation by contact between the bolt and the raised portion of the bolt stop.

When a recharged magazine is inserted, the bolt-hold-open assembly is in full clockwise rotation, held in position by contact between the bolt and the raised portion of the bolt stop. The presence of a cartridge in the inserted magazine exerts counter-clockwise force upon the elongated finger-like extension, raising and pivoting the cartridge detecting lever upward in a counter-clockwise direction. Counter-clockwise pivoting of the lever and resulting compression of the lever spring does not affect the position of the bolt stop because it is held in its clockwise rotation by contact with the bolt in its retracted position. Insertion of the recharged magazine does not therefore affect the position of the bolt stop or release the held bolt.

Release of the bolt, when held in its rearward position by the raised portion of the bolt stop, to allow discharge of the firearm after reloading may be accomplished by either pulling the held-open bolt rearward or by pushing the bolt stop handle, located in front of the trigger guard, forward in a counter-clockwise direction. Pulling the held-open bolt rearward discontinues contact between the bolt and the bolt stop. This allows the lever spring, which is partially compressed by counter-clockwise pivoting of the lever due to the presence of a cartridge in the magazine, to partially decompress, allowing counter-clockwise rotation of the bolt stop to a position of zero rotation. Alternatively, pushing the bolt stop handle forward forces the bolt stop to rotate counter-clockwise to a position of zero rotation, thereby disengaging the bolt stop from contact with the bolt and allowing partial decompression of the lever spring.

The finger-like extension of the cartridge detecting lever may also function as a cartridge ejector. As the bolt retracts after the firearm is discharged, the bolt extracts the spent cartridge case from the chamber. During use of the firearm with a magazine inserted, as the cartridge is drawn rearward by the bolt, the cartridge head collides with an ejector tab which projects from the magazine upper surface forward of the channel cutout. Collision with the ejector tab interrupts the rearward path of the spent cartridge case and ejects the spent cartridge case from the chamber.

If the firearm is discharged without the magazine in place, the finger-like extension of the cartridge detecting lever functions to eject cartridges from the firearm in place of the absent magazine ejector tab. While the bolt is traveling rearward, the bottom surface of the bolt travels along the upper surface of the bolt stop, holding the bolt hold-open assembly in a position of zero clockwise rotation. Consequently, during rearward travel of the bolt, the elongated finger-like extension of the cartridge detecting lever is in the proper position to perform cartridge ejection. During extraction of the spent cartridge, the bolt pulls the cartridge past the usual position of the absent magazine ejector tab to a position where it collides with the elongated finger-like extension of the cartridge detecting lever and is then ejected. Then, when the bolt nears the end of its rearward travel and the bottom surface of the bolt clears the upper surface of the bolt stop, the bolt hold-open assembly rotates into a position of full clockwise rotation, securing the bolt open in its rearward position. This occurs after ejection of the spent cartridge has occurred.

Even more particularly, the preferred embodiment of the present invention comprises a bolt hold-open assembly for mounting on the trigger housing of a firearm, comprising a magazine, preferably rotary, with a channel cutout for interfacing at the cartridge head position with a lever and a cartridge ejector tab; a bolt stop having a top end with an upper surface, a middle portion with a first rod extending therefrom, a bottom end with a first orifice for receiving a pin to allow rotation of the bolt stop, a slot located toward the top end with a slot top end and slot bottom end, and a handle attached near the bolt stop bottom end; a lever having a first end which is an elongated finger-like extension for interfacing with a channel cutout in a magazine to detect the presence or absence of a cartridge and for ejecting a spent cartridge, and a second end having a protruding tab and a second rod extending therefrom; the lever being pivotably connected to the bolt stop at a pivot point; the slot receiving the protruding tab, the protruding tab being movable towards an end of the slot when the lever is pivoted; the length of said slot limiting the degree of pivoting of the lever; a lever spring mounted over and compressed between the first and second rods, where the lever spring encourages the protruding tab to bias against the slot top end; a member containing a second orifice projecting from the bolt stop middle portion; a bolt stop spring, mounted on a hammer bushing, having a first leg and a second leg, the first leg in tension against a trigger housing surface and the second leg received by the second orifice; the bolt stop spring exerting clockwise force against the assembly, and the clockwise force exerted by the bolt stop spring being less than the upward bias exerted by the lever spring; the bolt stop rotating about the pin received by the first orifice located towards the bolt stop bottom end; where, when the protruding tab is in contact with the slot top end, the bolt stop and the lever rotate clockwise as a unit about the pin when counter-clockwise force on the lever is decreased; where, when the raised portion of the bolt stop upper surface has pressure exerted upon it by a bolt, preventing counter-clockwise rotation of the bolt stop about the pin, the lever will pivot about the pivot point when counter-clockwise force is exerted on the elongated extension and the protruding tab will move toward the slot bottom end; and where, when the pressure upon the raised portion of the bolt stop upper surface is relieved, the bolt stop will rotate counter-clockwise about the pin to a position of zero rotation, and the protruding tab will move toward the slot top end. The application of counter-clockwise force to the bolt stop handle will force counter-clockwise rotation of the bolt stop about the pin until the raised portion of the bolt stop upper surface disengages from contact with the bolt, allowing decompression of the lever spring. Pulling the retracted bolt rearward will also disengage contact with the raised portion of the bolt stop upper surface, allowing counter-clockwise rotation of the bolt stop about the pin and decompression of the lever spring until the bolt hold-open assembly reaches a position of zero rotation.

BRIEF DESCRIPTION Of THE DRAWINGS

A better understanding of the present invention will be had upon reference to the following description in conjunction with the accompanying drawings, wherein.

DETAILED DESCRIPTION OF THE PREFERRED EMBODIMENT

Figure 9:
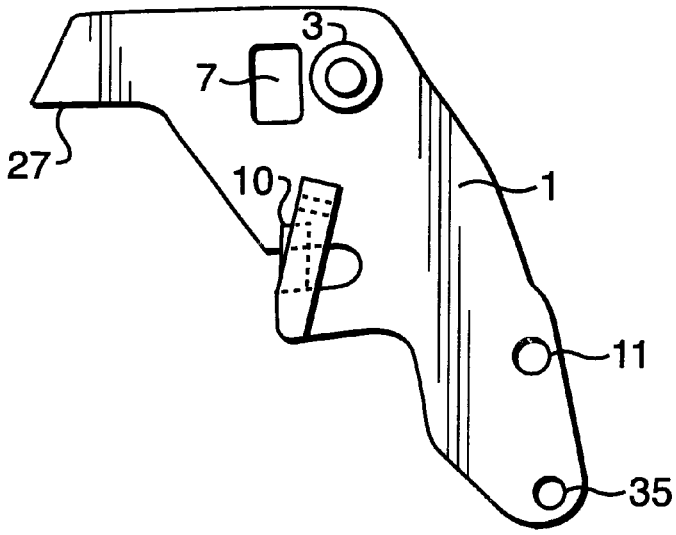
FIG. 9 is a side view of the bolt stop.
Figure 10:
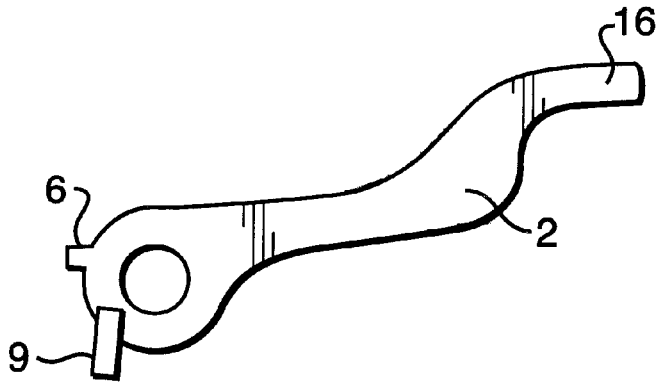
FIG. 10 is a side view of the cartridge detecting lever.

With reference to the Figures, FIGS. 1, 2, 6 and 8 show the bolt hold-open assembly 40 of the preferred embodiment, having a bolt stop 1, a cartridge detecting lever 2, a lever spring 8, a bolt stop spring 14, and a bolt stop handle 12. Cartridge detecting lever 2, depicted individually in FIG. 10, has an elongated finger-like extension 16 at one end of cartridge detecting lever 2 for interfacing with channel cutout 17 in magazine 18 (FIGS. 3–5), and a protruding tab 6 and fixed rod 9 at the opposed end of cartridge detecting lever 2. Bolt stop 1, depicted individually in FIG. 9, has a boss 3 for pivotable connection of the cartridge detecting lever 2 to the bolt stop 1, a bolt stop slot 7, a fixed rod 10, a preferably "L" shaped projection 26 containing a second orifice 25, a first orifice 11 for receiving a magazine latch pivot pin 36, the magazine latch pivot pin 36 being a standard factory component, and a third orifice 35 for receiving bolt stop handle screw 13. Bolt stop handle 12 is affixed to bolt stop 1 by bolt stop handle screw 13, screw 13 received through third orifice 35. Cartridge detecting lever 2 is pivotably mounted on bolt stop 1 at boss 3, held in place by washer 5 and screw 4, and pivots in position on boss 3.

Figure 12:
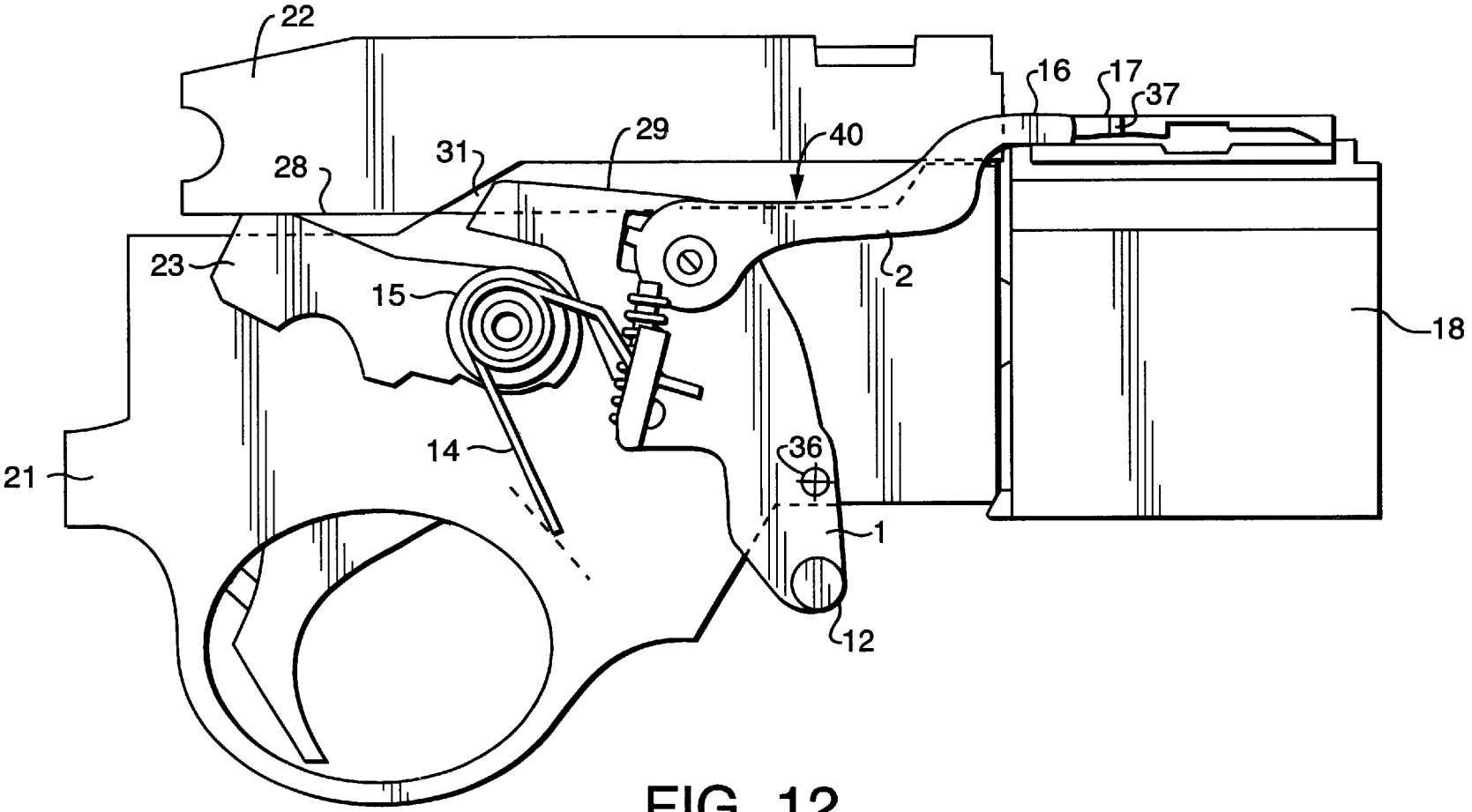
FIG. 12 is a side view of the bolt hold-open assembly, including magazine, of the present invention mounted in position on a factory produced trigger housing and demonstrating the position and relationship of all components with the bolt held in a retracted position by contact with the rotated bolt stop and with the absence of a cartridge in the magazine, the bolt stop assembly being in a position of full clock-wise rotation.
Figure 13:
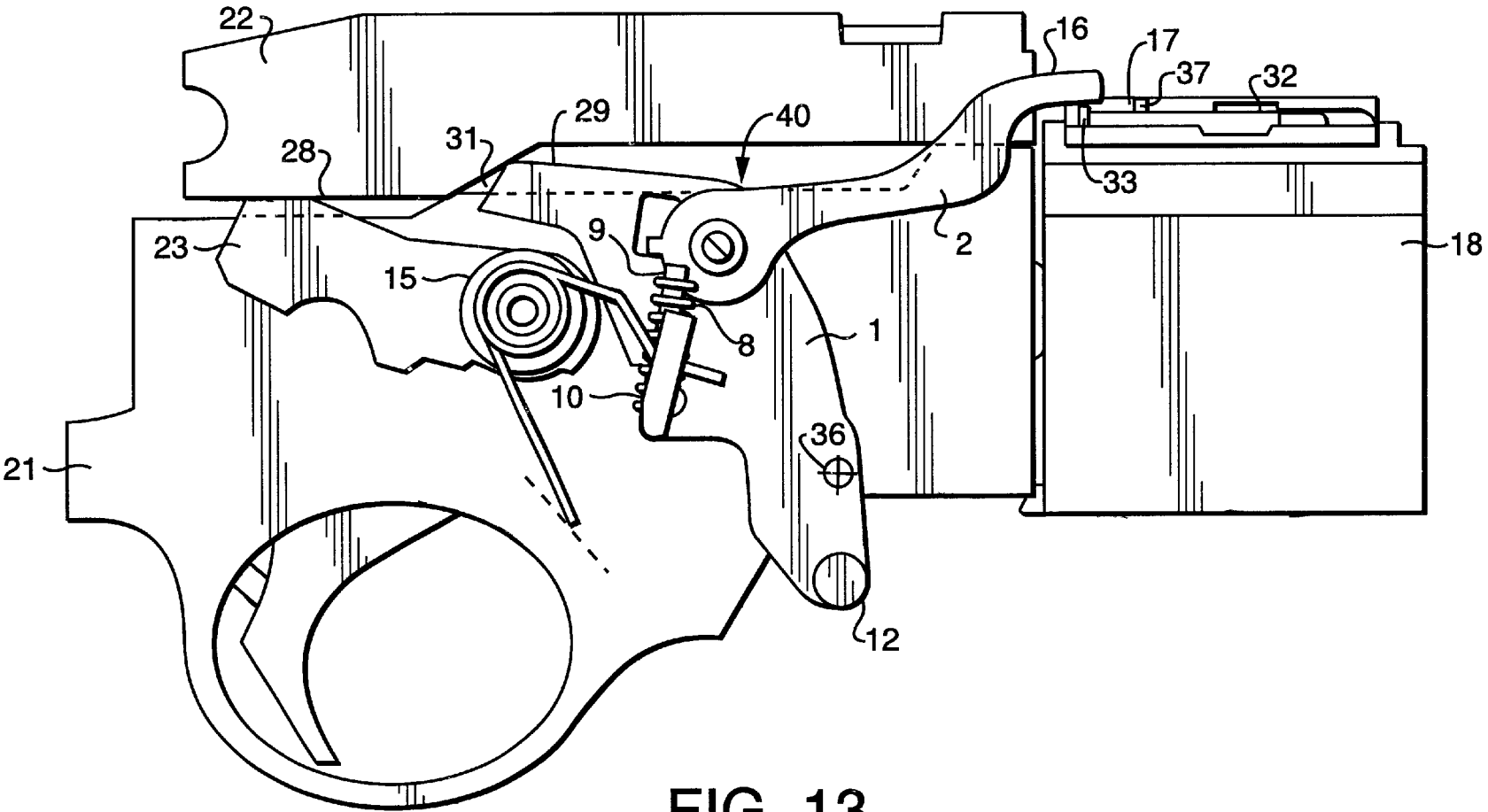
FIG. 13 is a side view of the bolt hold-open assembly, including magazine, of the present invention mounted in position on a factory produced trigger housing and demonstrating the position and relationship of all components with the bolt held in a retracted position by contact with the rotated bolt stop and with a loaded magazine at full insertion, the bolt stop rotated clockwise and the cartridge detecting lever pivoted counter-clockwise.
Figure 14:
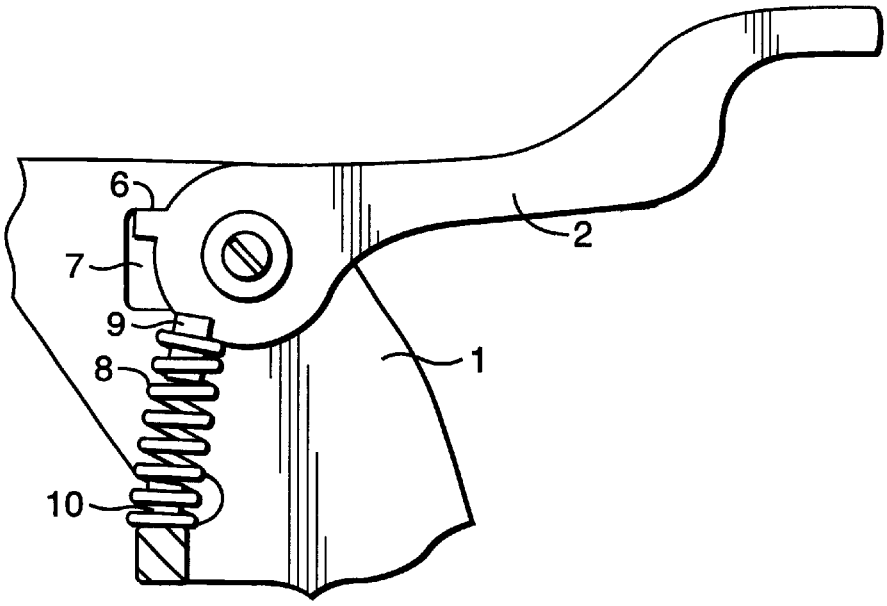
FIG. 14 is a close up sectional view demonstrating the relationship of the bolt stop and the cartridge detecting lever with cartridge detecting lever at maximum clockwise pivot position, protruding tab at top end of bolt stop slot, and lever spring at maximum allowed decompression.
Figure 15:
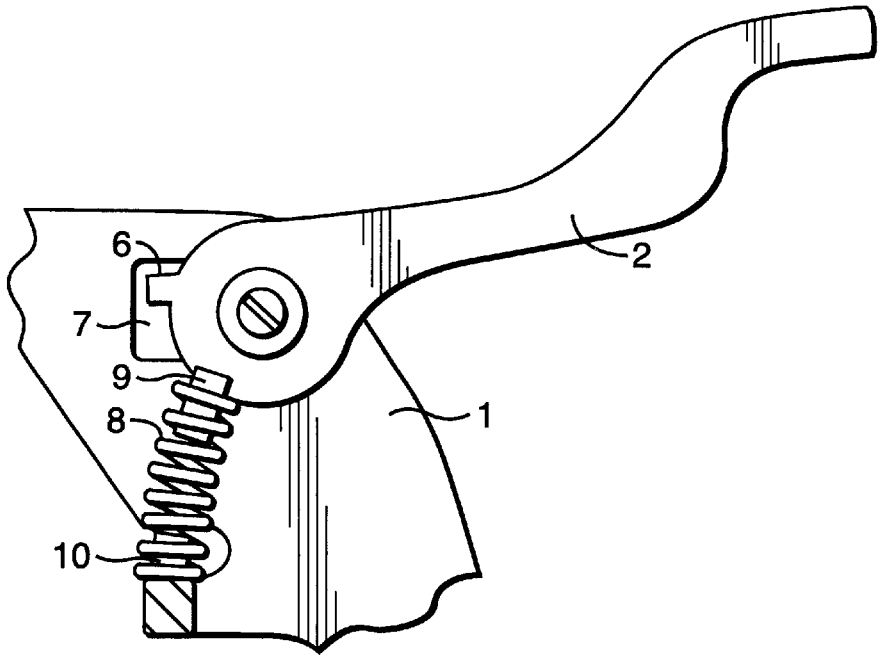
FIG. 15 is a close up sectional view demonstrating the relationship of the bolt stop and cartridge detecting lever with cartridge detecting lever pivoted counter-clockwise, compressing lever spring.
Figure 11:
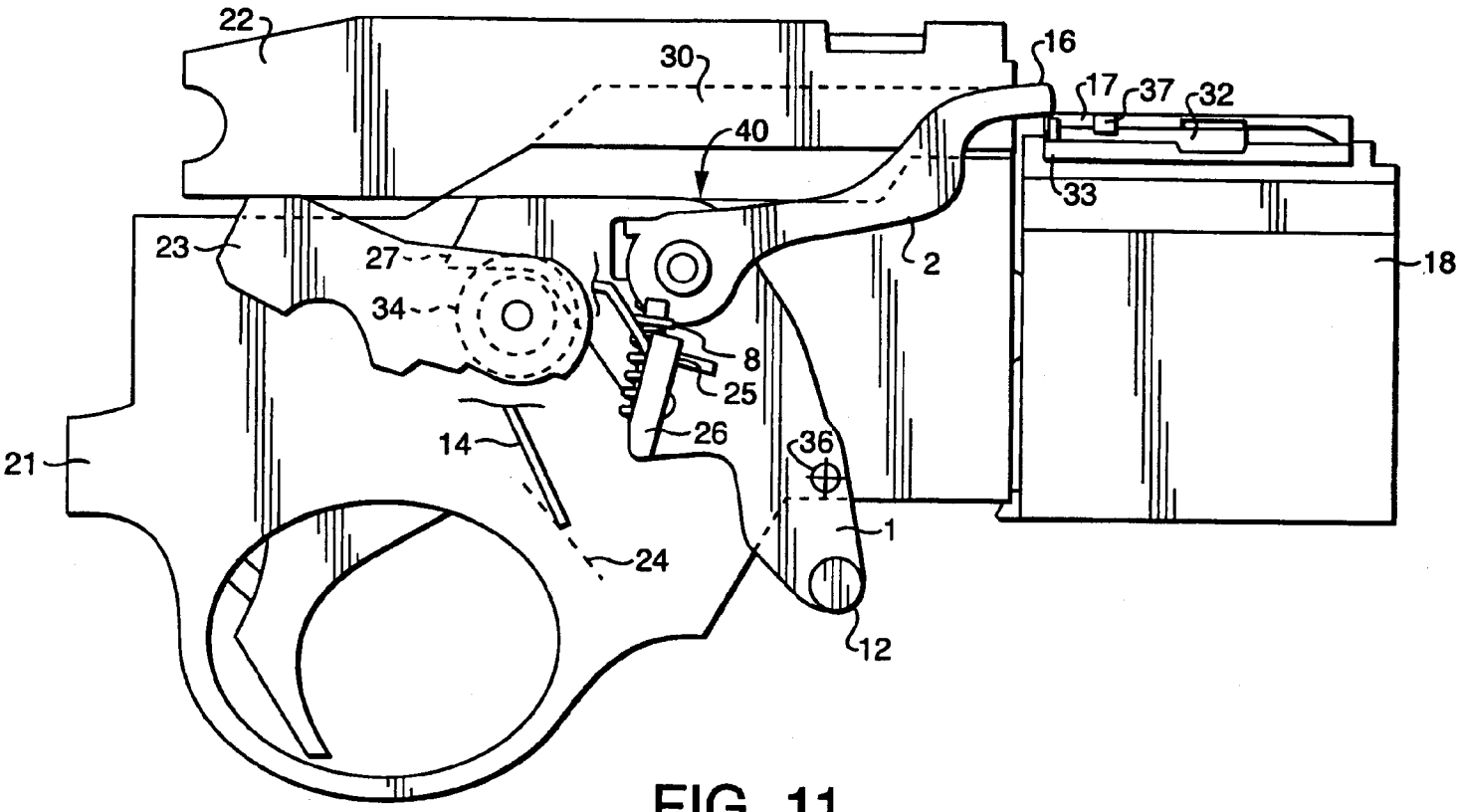
Figure 12:
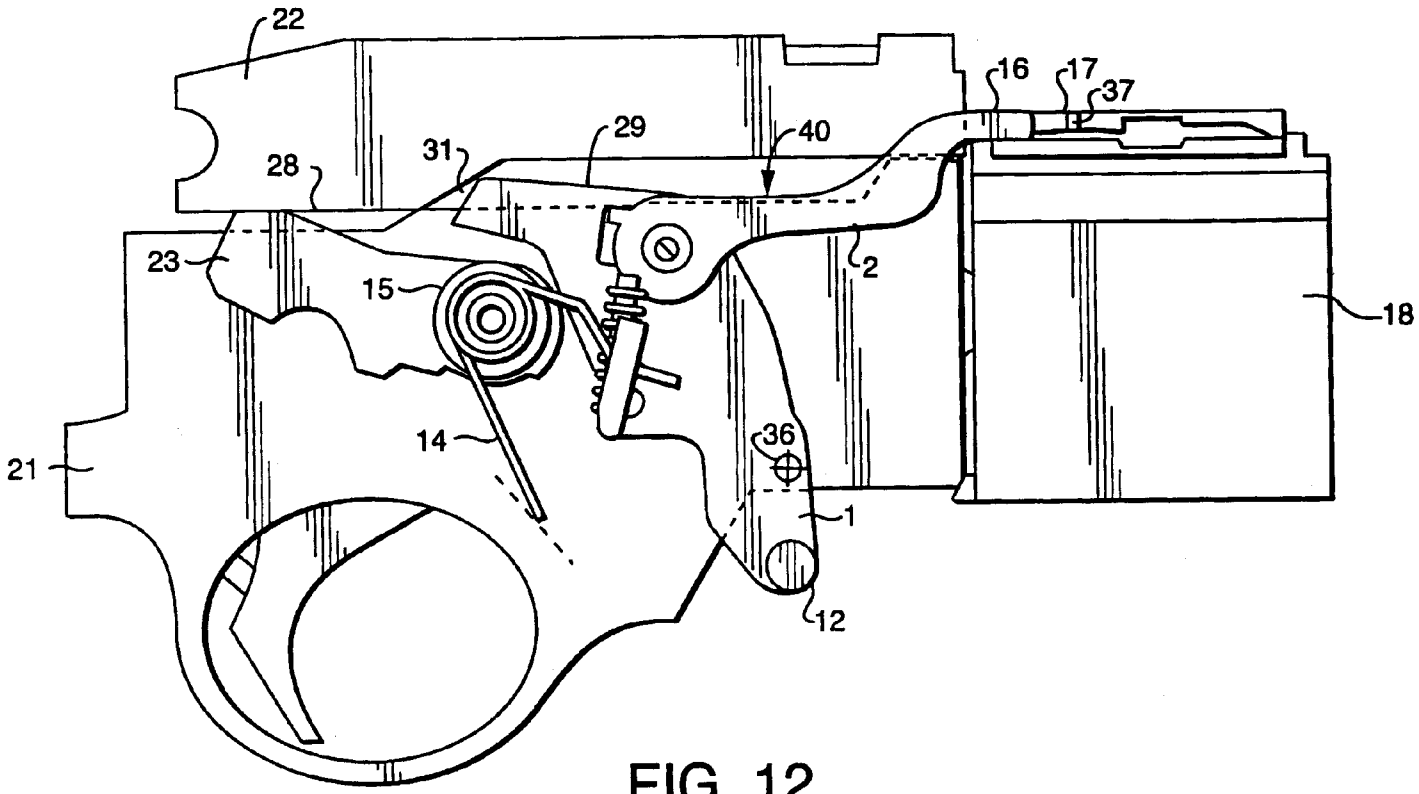
Figure 13:
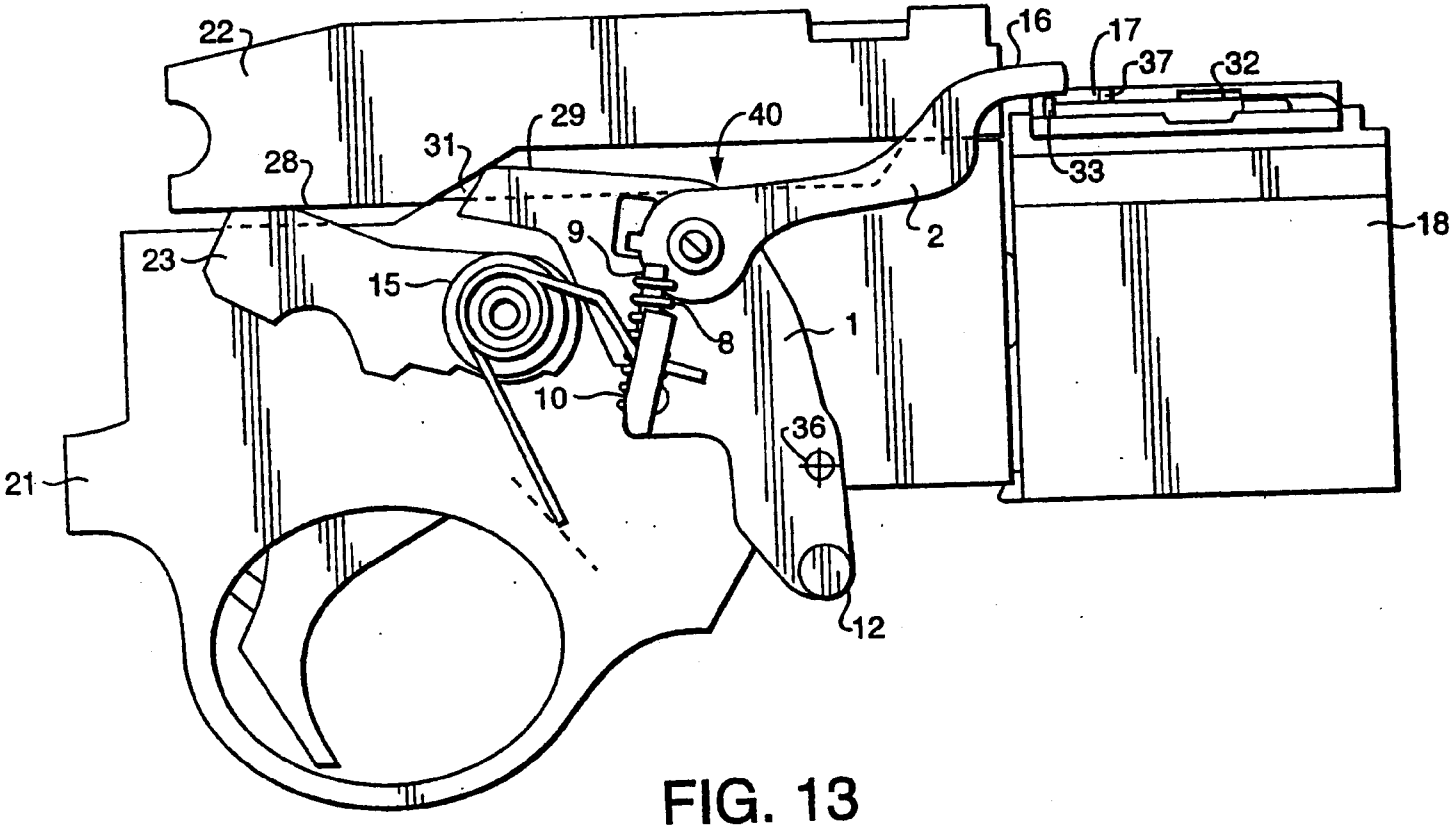

As shown in FIGS. 1, 2, 8, 11–15, and as best shown in FIG. 14, a lever spring 8 is mounted over and compressed between fixed rods 9, 10 located respectively on cartridge detecting lever 2 and bolt stop 1. Lever spring 8 has an upward bias which encourages protruding tab 6 against the top end of slot 7, causing clockwise pivoting of cartridge detecting lever 2. Rotation of cartridge detecting lever 2 is also determined by the absence or presence of a cartridge 32 in the magazine 18 (FIGS. 11–13), which affects the position of lever extension 16 of the cartridge detecting lever 2. Protruding tab 6 of cartridge detecting lever 2 travels within bolt stop slot 7 located on bolt stop 1 (FIGS. 1, 11–15). Protruding tab 6 is generally held to top of slot 7 by pressure exerted upon ejector-lever 2 by lever spring 8 (FIG. 14). Counter-clockwise pivoting of the cartridge detecting lever 2 compresses lever spring 8 allowing counter-clockwise movement of protruding tab 6 within slot 7 (FIG. 15). The degree of counter-clockwise and clockwise pivoting of cartridge detecting lever 2 is circumscribed by the length of slot 7. However, in order to provide adequate clearance, slot 7 may be of a length greater than required for pivoting of cartridge detecting lever 2 and for downward movement of protruding tab 6 within slot 7.

The pivoting of cartridge:detecting lever 2 on boss 3 is better depicted in FIGS. 14 and 15. FIG. 14 shows lever spring 8 at maximum allowed decompression, with further clockwise pivoting of cartridge detecting lever 2 terminated by protruding tab 6 contacting top surface of slot 7. The relationship of fixed rods 9, 10 are also shown. FIG. 15 shows counter-clockwise pivoting of cartridge detecting lever 2. Protruding tab 6 is shown traveling in slot 7. Lever spring 8 is compressed and held captive by fixed rods 9, 10.

Figure 1:
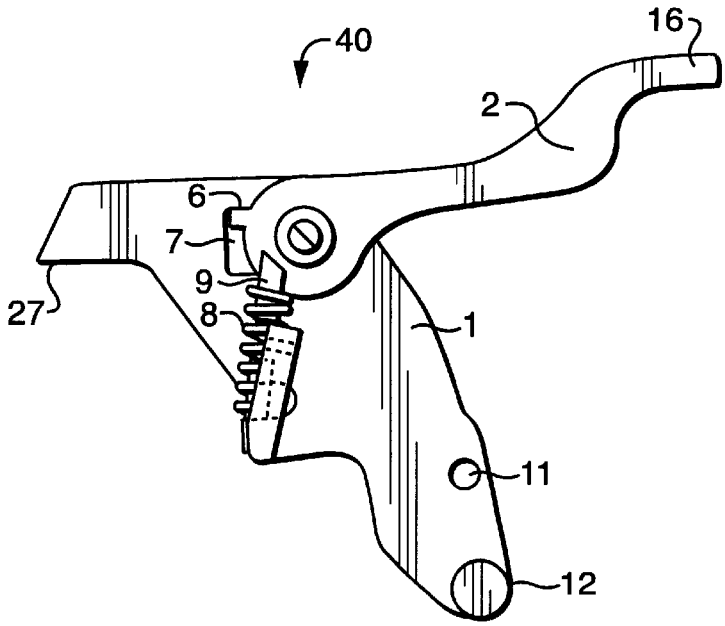
FIG. 1 is a side view of the bolt hold-open assembly of the present invention, comprising a bolt stop, cartridge detecting lever, and related components; however, the magazine is not shown.
Figure 2:
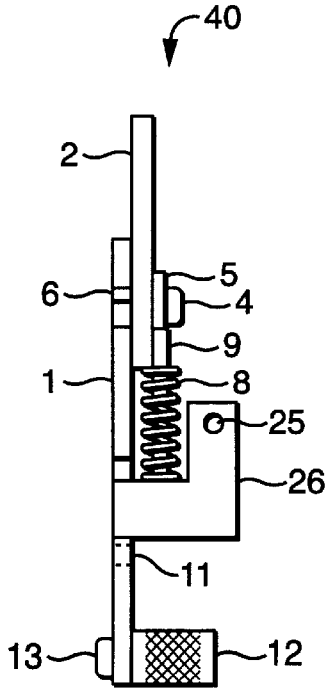
FIG. 2 is a rear view of the bolt hold-open assembly of FIG. 1.
Figure 5:
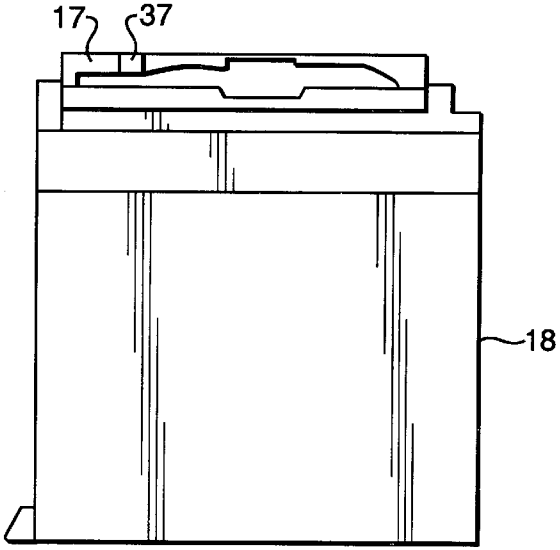
FIG. 5 is a side view of the magazine of FIG. 3.
Figure 4:
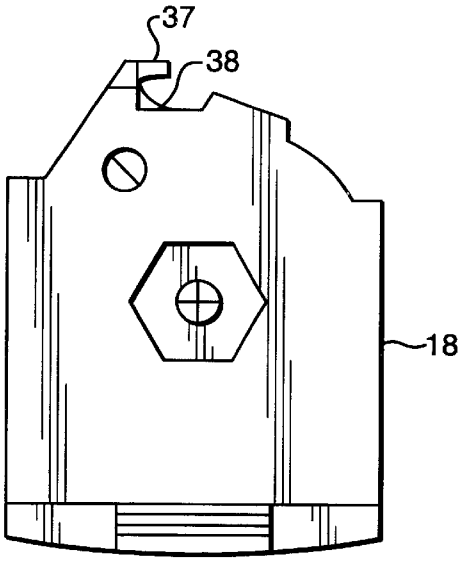
FIG. 4 is a rear view of the magazine of FIG. 3.
Figure 3:
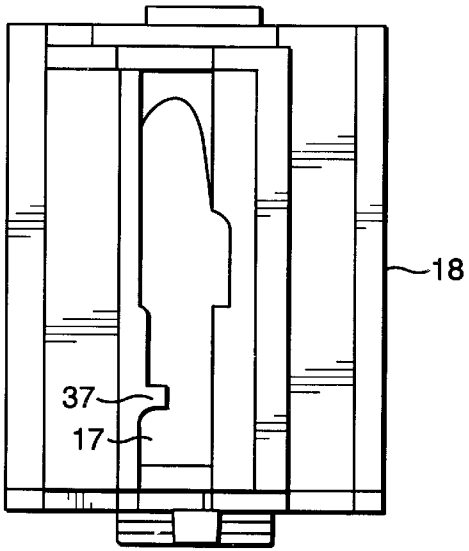
FIG. 3 is a top view of an empty ten-round magazine of the present invention, showing a channel cutout in the magazine at the cartridge head position for accepting the elongated finger-like extension of the cartridge detecting lever.
Figure 6:
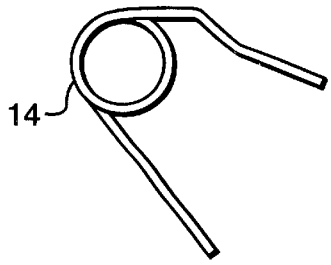
FIG. 6 is a side view of the bolt stop spring.
Figure 11:
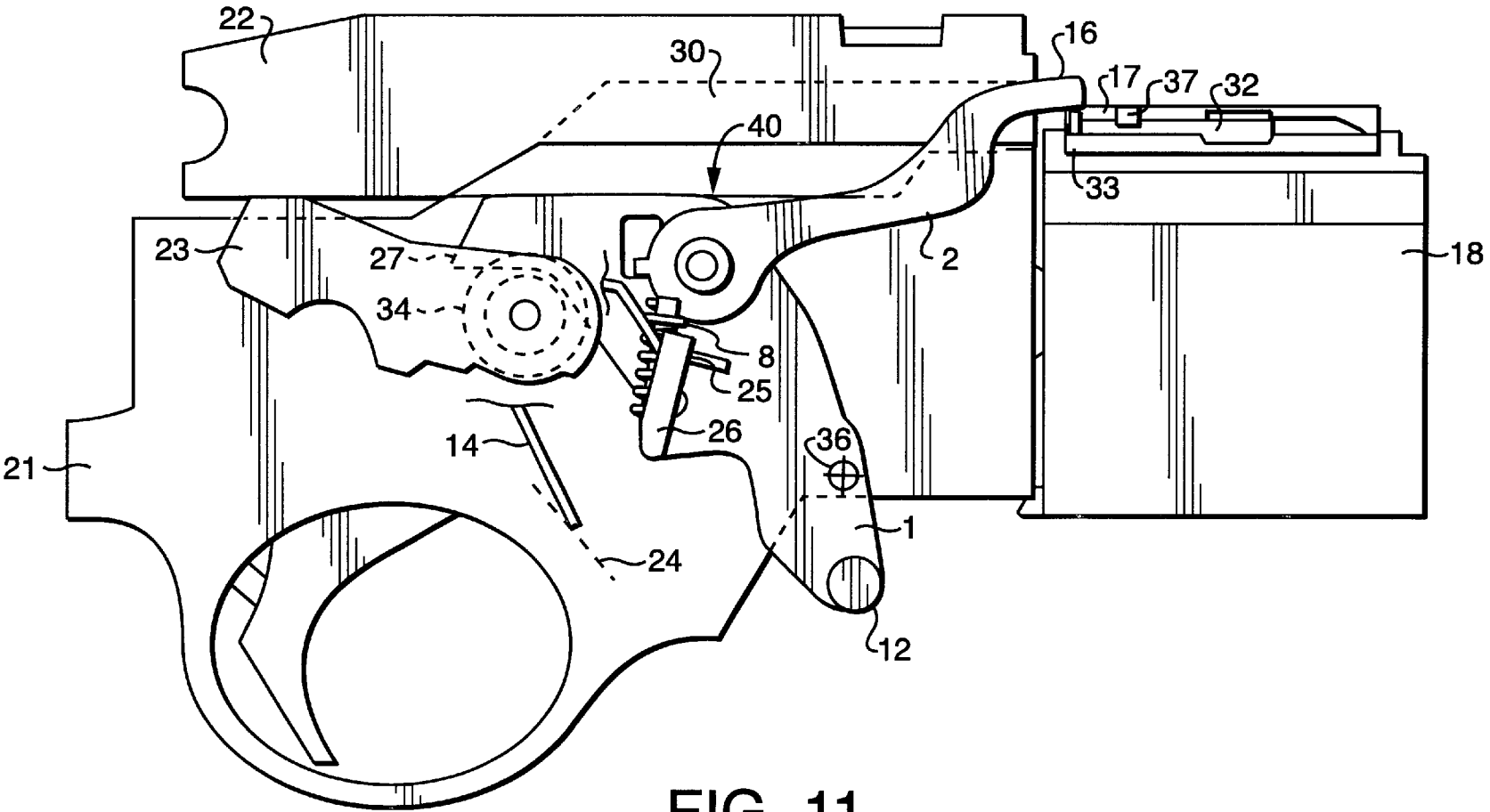
FIG. 11 is a side view of the bolt hold-open assembly, including magazine, of the present invention mounted in position on a factory produced trigger housing and demonstrating the position and relationship of all components with-the bolt in a retracted position and a cartridge present in the magazine port, the bolt assembly being in a position of zero rotation.

FIGS. 3–5 show a ten-round rotary magazine 18 of the present invention. The preferably rotary magazine 18 is modified from standard by the presence of a channel cutout 17, which accepts the elongated finger-like extension 16 of cartridge detecting lever 2. As shown in FIGS. 11 and 13, when a cartridge 32 is present in the magazine 18, the cartridge head 33 is positioned at the location of channel cutout 17. This configuration allows the cartridge head 33 to hold the lever extension 16 upward. When the last cartridge 32 in the magazine 18 is dispelled from the magazine 18 and not replaced, upward pressure on the lever extension 16 is relieved, allowing the lever extension 16 to pivot clockwise until lever extension 16 rests upon the floor 38 of said magazine channel cutout 17.

As shown in FIGS. 3–5, an ejector tab 37 projects upward from a side of the magazine 18 upper surface. The ejector tab 37 may be located on the left side of the magazine 18 upper surface for use in right-handed firearms or on the right side of the magazine 18 upper surface for use in left-handed firearms. The ejector tab 37 is positioned to interrupt the rearward path of the spent cartridge case 32 and to eject the spent cartridge case 32.

The bolt hold-open assembly 40 rotates in its entirety upon magazine latch pivot pin 36, inserted through and received by bolt stop first orifice 11. The position and rotation of the bolt hold-open assembly 40 is determined by the presence or absence of cartridge head 33 at channel cutout 17. FIG. 11 shows zero rotation of bolt hold-open assembly 40 upon magazine latch pivot pin 36 due to the presence of a cartridge 32 at magazine channel cutout 17. The cartridge 32 holds the cartridge detecting lever extension 16 upward. Compression of the lever spring 8 overcomes the force of bolt stop spring 14, thus preventing bolt hold-open assembly 40 from rotating clockwise.

Figure 7:
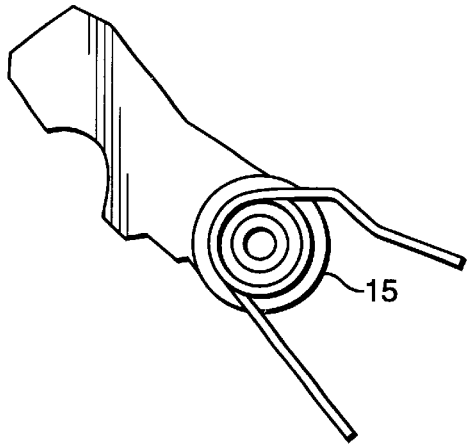
FIG. 7 is a side view of the bolt stop spring mounted in position on a hammer bushing.
Figure 8:
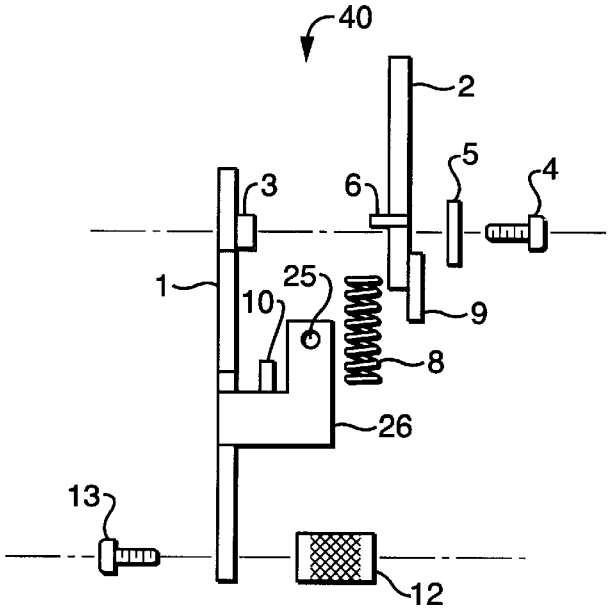
FIG. 8 is an exploded rear view of the bolt hold-open assembly of FIGS. 1–2.

FIGS. 11–13 illustrate the bolt hold-open assembly 40 of the present invention placed in position in relation to the factory produced trigger housing 21. The bolt 22 is shown at its retracted position, holding hammer 23 in a cocked position. The bolt stop spring 14 rides in correct position upon factory supplied right hammer bushing 15, as depicted in FIG. 7. In FIGS. 11–13, the bolt stop spring 14 is shown in correct relationship with hammer 23. Right hammer bushing 15, depicted in FIG. 7, is present in FIGS. 12 and 13 and omitted from FIG. 11. Bolt stop spring 14 exerts clockwise force upon the bolt hold-open assembly 40. One leg of bolt stop spring 14 is held in tension against surface of trigger housing 24. The second leg of bolt stop spring 14 is inserted in and held captive by second orifice 25 in projection 26, which configuration provides clockwise force encouraging clockwise rotation of bolt hold-open assembly 40. Both second orifice 25 and projection 26 are better seen in FIGS. 2 and 8.

FIG. 11 depicts zero rotation of bolt hold-open assembly 40 upon magazine latch pivot pin 36 due to the presence of a cartridge 32 at channel cutout 17 of fully inserted preferably rotary magazine 18. The cartridge head 33 holds the lever extension 16 upward. Force from the compression of the lever spring 8 overcomes the force of bolt stop spring 14, thereby keeping bolt hold-open assembly 40 from rotating clockwise. In this scenario, further counter-clockwise rotation of bolt hold-open assembly 40 upon magazine latch pivot pin 36 is eliminated by surface 27 of bolt stop 1, shown also in FIG. 1 and FIG. 9, coming into contact with the left hammer bushing 34 (FIG. 11) located on the left side of hammer 23 and identical to right hammer bushing 15 (FIGS. 12–13).

FIG. 12 shows the position of the bolt hold-open assembly 40 when no cartridge 32 is present in the preferably rotary magazine 18 at magazine channel cutout 17. The bolt 22 is at its retracted position with bolt bottom surface 28 clear of upper surface 29 of bolt stop 1. In this configuration, with no cartridge 32 at channel cutout 17, bolt stop spring 14 is allowed to decompress, rotating the bolt hold-open assembly 40 in its entirety clockwise upon magazine latch pivot pin 36. Rotation is terminated when the elongated finger-like extension 16 of cartridge detecting lever 2 contacts the floor 38 of the magazine channel cutout 17.

As depicted in FIG. 11, a clearance groove 30 is present in the bottom of bolt 22. Lever extension 16 and the upper extremity of cartridge detecting lever 2 ride uninhibited in clearance groove 30 during forward and rearward motion of bolt 22.

While the bolt 22 is traveling rearward, the bottom surface 28 of the bolt 22 travels along the upper surface 29 of the bolt stop 1 and holds the bolt hold-open assembly 40 in a position of zero clockwise rotation. Thus, during rearward travel of the bolt 22, the elongated finger-like extension 16 of the cartridge detecting lever 2 is held upward in the proper position to perform cartridge 32 ejection during rearward travel of bolt 22. During extraction of the spent cartridge case 32 when no preferably rotary magazine 18 is present, the bolt 22 pulls the spent cartridge case 32 past the usual position of the absent magazine ejector tab 37 to a position where it collides with the elongated finger-like extension 16 of the cartridge detecting lever 2 and is then ejected. Then, when the bolt 22 nears the end of its rearward travel and the bottom surface 28 of the bolt 22 clears the upper surface 29 of the bolt stop 1, the bolt hold-open assembly 40 rotates into a position of full clockwise rotation, as shown in FIG. 12, securing the bolt 22 open in its rearward position. This occurs after ejection of the spent cartridge 32 has occurred.

As shown in FIGS. 12–13, clockwise rotation of bolt hold-open assembly 40 raises portion 31 of the upper surface 29 of bolt stop 1 above upper surface of factory trigger housing 21. The raised portion 31 of bolt stop upper surface 29 when in contact with the surface of bolt 22 prevents the bolt 22 from further forward movement.

FIG. 13 illustrates the position of the bolt hold-open assembly 40 after reinsertion of a freshly loaded preferably rotary magazine 18 with bolt 22 held in retracted position by contact with the raised portion 31 of bolt stop upper surface 29 and bolt hold-open assembly 40 held in a clockwise rotated position. A cartridge 32 is present at magazine channel cutout 17 with preferably rotary magazine 18 at full insertion, with cartridge 32 under pressure by follower spring (not shown) of magazine 18. The finger-like extension 16 of cartridge detecting lever 2 is pushed upward by the cartridge head 33, pivoting cartridge detecting lever 2 counter-clockwise upon boss 3. Counter-clockwise pivoting of the cartridge detecting lever 2 rotates protruding tab 6 downward in bolt stop slot 7 and compresses lever spring 8, held captive by fixed rods 9, 10.

When the bolt is held in its rearward position as shown in FIGS. 12–13, the factory recoil spring (not shown) of the firearm, which drives bolt 22 forward, applies pressure to the bolt 22 which in turn applies pressure to the bolt stop 1 at the raised portion 31 of bolt stop upper surface 29. Until released, this pressure is great enough to prevent the counter-clockwise rotation of bolt stop 1 upon force provided by pivoting of cartridge detecting lever 2 and resulting compression of lever spring 8. If bolt 22 is manually pulled rearward, relieving pressure at the raised portion 31 of bolt stop upper surface 29, lever spring 8 will be allowed to partially decompress, forcing counter-clockwise rotation of bolt stop 1 upon magazine latch pivot pin 36 and rotating upper surface 29 of bolt stop 1 downward and clear of the bottom surface 28 of bolt 22. Releasing bolt 22 puts all components back to positions seen in FIG. 11 and allows the bolt 22 to complete travel forward.

Manual counter-clockwise rotation of the bolt hold-open assembly 40 to overcome pressure exerted by the bolt 22 at the raised portion 31 of bolt stop upper surface 29 may also be accomplished by manually pushing forward bolt stop handle 12 in a counter-clockwise direction, which forces counter-clockwise rotation of bolt stop 1 upon magazine latch pivot pin 36 until surface 29 of the bolt stop 1 is clear of the bottom surface 28 of bolt 22, allowing decompression of lever spring 8.

Decompression of lever spring 8 upon counter-clockwise rotation of bolt stop 1 causes clockwise pivoting of cartridge detecting lever 2 upon boss 3. With cartridge 32 at channel cutout 17 holding finger-like extension 16 upward, extension 16 is drawn rearward over cartridge head 33 until rotations of bolt stop 1 upon magazine latch pivot pin 36 and cartridge detecting lever 2 at boss 3 are complete.

The foregoing detailed description is given primarily for clearness of understanding and no unnecessary limitations are to be understood therefrom for modifications can be made by those skilled in the art upon reading this disclosure and may be made without departing from the spirit of the invention and scope of the appended claims.

What is claimed is:

1. A bolt hold-open assembly, comprising:

a) a bolt stop having a top end, a middle portion, a bottom end, an upper surface at said top end, a first orifice toward said bottom end, and a slot located toward said top end, said slot having a slot top end and a slot bottom end;

b) a lever with a first end and a second end, where said first end is an elongated extension for detecting the presence of a cartridge in a magazine and said second end has a protruding tab;

c) where, if said cartridge is present in said magazine, said elongated extension will rest upon a head of said cartridge, and if said cartridge is not present in said magazine, said elongated extension will interface with a channel cutout in said magazine;

d) where said lever is pivotably connected to said bolt stop at a pivot point;

e) where said slot receives said protruding tab, said protruding tab is movable along the length of said slot when said lever is pivoted, and where the length of said slot limits the degree of pivoting of said lever;

f) where said bolt stop rotates about a pin received by said first orifice; and g) where a handle is attached to said bolt stop at a location toward said bolt stop bottom end.

2. The bolt hold-open assembly as recited in claim 1, further comprising a first rod extending from said middle portion of said bolt stop, a second rod extending from said second end of said lever, and a lever spring mounted over and compressed between said first and said second rods, where said lever spring encourages said protruding tab to bias against said slot top end.

3. The bolt hold-open assembly as recited in claim 1, where a) when said protruding tab is in contact with said slot top end, said bolt stop and said lever rotate clockwise as a unit about said pin when counter-clockwise force on said lever is decreased and a portion of said upper surface of said bolt stop is raised;

b) when said raised portion of said bolt stop upper surface has pressure exerted upon it, preventing counter-clockwise rotation of said bolt stop about said pin, said lever will pivot about said pivot point when counter-clockwise force is exerted about said elongated extension and said protruding tab will move toward said slot bottom end; and c) when said pressure upon said raised portion of said bolt stop upper surface is relieved, said bolt stop will rotate counter-clockwise about said pin to a position of zero rotation, and said protruding tab will move toward said slot top end.

4. The bolt hold-open assembly as recited in claim 2, where a) when said protruding tab is in contact with said slot top end, said bolt stop and said lever rotate clockwise as a unit about said pin when counter-clockwise force on said lever is decreased;

b) when said raised portion of said bolt stop upper surface has pressure exerted upon it, preventing counter-clockwise rotation of said bolt stop about said pin, said lever will pivot about said pivot point when counter-clockwise force is exerted upon said elongated extension and said protruding tab will move toward said slot bottom end; and c) when said pressure exerted upon said raised portion of said bolt stop upper surface is relieved, said bolt stop will rotate counter-clockwise about said pin to a position of zero rotation, and said protruding tab will move toward said slot top end.

5. The bolt hold-open assembly as recited in claim 4, where said assembly is rotatably mounted on the trigger housing of a firearm and further comprises a member projecting from said bolt stop middle portion with said member containing a second orifice, a bolt stop spring having a first leg and a second leg, said bolt stop spring mounted on a bushing located on hammer of said firearm, said first leg in tension against surface of said trigger housing, said second leg received by said second orifice, said bolt stop spring exerting clockwise force against said assembly, and said clockwise force exerted by said bolt stop spring being less than said upward bias exerted by said lever spring.

6. The bolt hold-open assembly as recited in claim 5, where said pressure exerted upon said raised portion of said bolt stop upper surface is exerted by a bolt, retracted toward the rear of said firearm, said bolt held in said retracted position by contact with said raised portion of said bolt stop upper surface.

7. The bolt hold-open assembly as recited in claim 6, where applying counter-clockwise force to said handle will force counter-clockwise rotation of said bolt stop about said pin until said raised portion of said bolt stop upper surface disengages from contact with said bolt, allowing decompression of said lever spring.

8. The bolt hold-open assembly as recited in claim 6, where pressure exerted upon said bolt stop upper portion by said bolt as said bolt retracts toward said rear of said firearm prevents said bolt hold-open assembly from rotating clockwise, allowing said elongated extension to operate as a cartridge case ejector.

9. The bolt hold-open assembly as recited in claim 5, further comprising a magazine having a channel cutout which receives said elongated extension of said lever, where said elongated extension interfaces with said channel cutout in said magazine.

10. The bolt hold-open assembly as recited in claim 9, where said magazine channel cutout is located at a cartridge head end of said magazine, allowing said elongated extension to rest upon said head of said cartridge when said magazine contains said cartridge and to pivot clockwise to rest upon the floor of said magazine channel cutout when said cartridge is not present in said magazine.

11. The bolt hold-open assembly as recited in claim 9, where said magazine has an ejector tab for ejecting a case of said cartridge, said ejector tab projecting upward from said magazine forward of said channel cutout.

12. The bolt hold-open assembly as recited in claim 9, where said magazine has a rotary design.

* * * * *

UNITED STATES PATENT AND TRADEMARK OFFICE

CERTIFICATE OF CORRECTION

PATENT NO. : 6,510,778 B1
DATED : January 28, 2003
INVENTOR(S) : Michael B. Irwin It is certified that error appears in the above-identified patent and that said Letters Patent is hereby corrected as shown below:

Drawings,
Please replace Figures 11, 12 and 13 with the attached Figures 11, 12 and 13.

Signed and Sealed this

Twentieth Day of April, 2004

JON W. DUDAS
*Acting Director of the United States Patent and Trademark Office*